United States Patent [19]

Caro Roqueta

[11] 4,023,242

[45] May 17, 1977

[54] CONNECTOR FOR CONCRETE-REINFORCING TENDONS

[75] Inventor: Eduardo Caro Roqueta, Barcelona, Spain

[73] Assignee: Buildinter A.G., Vaduz, Liechtenstein

[22] Filed: Aug. 19, 1975

[21] Appl. No.: 605,939

[30] Foreign Application Priority Data

May 14, 1975 United Kingdom ..... 20443/75

[52] U.S. Cl. ..... 24/122.6; 52/223 L; 52/230; 403/368; 24/115 M

[51] Int. Cl.² ..... F16G 11/04; E04C 5/12

[58] Field of Search ..... 24/122.6, 115 M; 52/230, 223 L, 223 R; 403/368, 369, 374; 254/29 A

[56] References Cited

UNITED STATES PATENTS

| | | | |
|---|---|---|---|
| 3,412,511 | 11/1968 | Dietrich | 52/223 L |
| 3,602,000 | 8/1971 | Meheen | 52/223 L |
| 3,658,296 | 4/1972 | Yegge | 52/230 |
| 3,701,509 | 10/1972 | Stinton | 52/223 L |

FOREIGN PATENTS OR APPLICATIONS

| | | | |
|---|---|---|---|
| 1,517,292 | 2/1968 | France | 52/230 |
| 20,766 | 8/1971 | Japan | 24/122.6 |
| 51,773 | 0000 | Poland | 52/223 L |

*Primary Examiner*—Bernard A. Gelak
*Attorney, Agent, or Firm*—Pennie & Edmonds

[57] ABSTRACT

A connector for connecting together end-to-end two sets of reinforcing tendons in a concrete structure, particularly at the junction of sections in a post-stressed structure, has respective sets of bores for the sets of tendons providing, for both sets, frusto-conical seats for gripping wedges for the tendons, and also has for one of the sets of tendons means for resiliently urging the wedges into their seats, in order to hold the tendons in place until they are tensioned. The two sets of bores may be in a gripping plate, and the resilient means in a spacing member abutting the plate.

9 Claims, 1 Drawing Figure

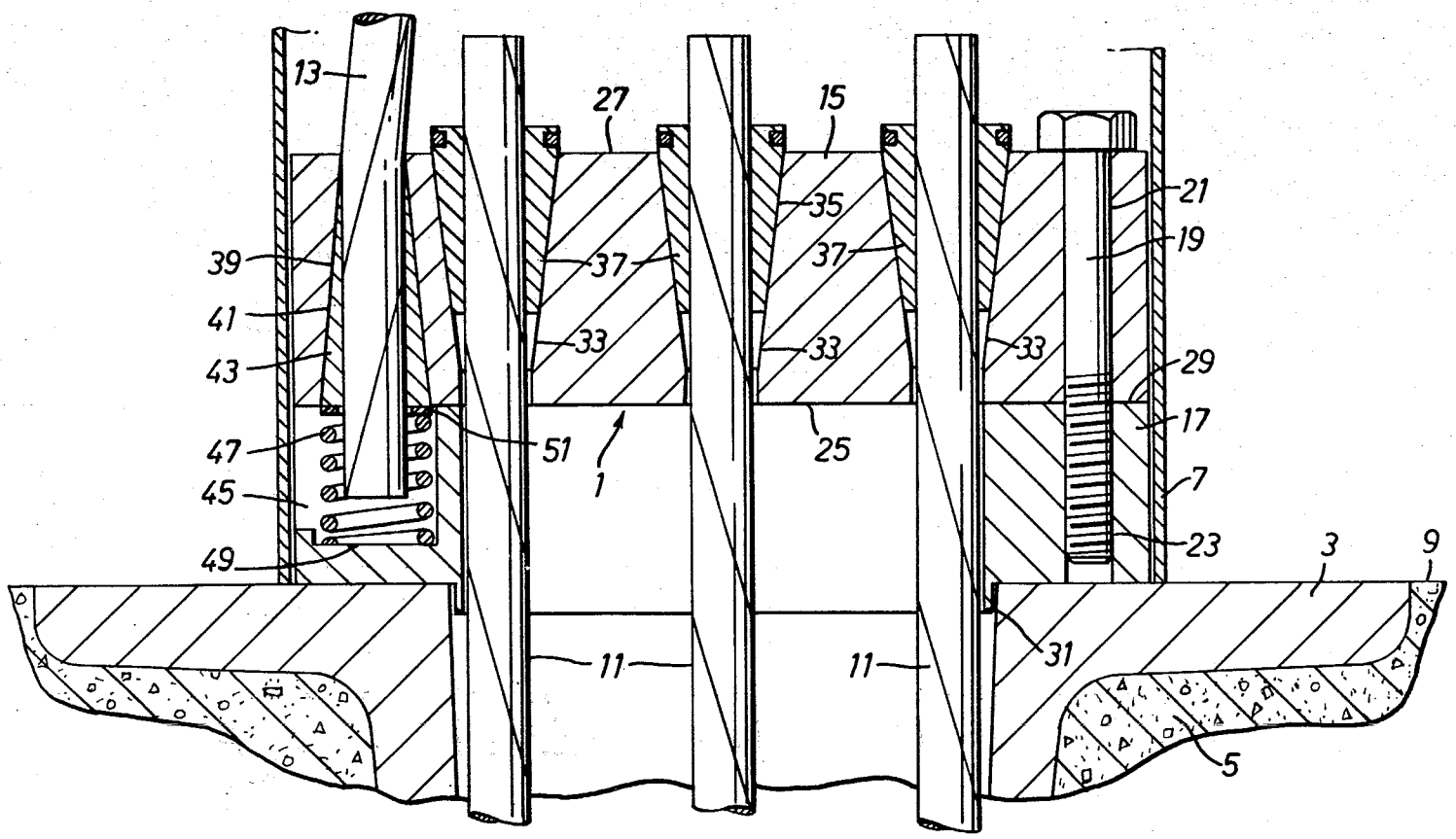
9
3
5
21
19
29
17
7
23
31
33
11
15
35
37
33
25
27
37
33
1
11
51
13
39
41
43
47
45
49

CONNECTOR FOR CONCRETE-REINFORCING TENDONS

BACKGROUND OF THE INVENTION

1. Field of the Invention

This invention relates to a connector for a plurality of tendons in a reinforced concrete structure, particularly a connector for use in post-stressed concrete structures. The invention further relates to a reinforced concrete structure including such a connector.

2. Description of the Prior Art

In a post-stressed concrete structure which is formed in a plurality of successively cast sections, the reinforcing tendons (which may be an individual wire or strand formed of a number of wires) are tensioned in each section after casting of the section and before casting of the next section. The set of tendons in a concrete section are connected, before tensioning, by means of a connector to thealready tensioned set of tendons of the preceding concrete section. The connector forms the "live" or jacking anchorage for the latter set of tendons and the "dead" or non-jacking anchorage for the former set. The connector is enveloped in a sleeve which protects it from the concrete which is then cast around it. After placement of the sleeve, there is for practical purposes no access to the connector.

In some known forms of connector for use in post-stressed concrete structures, the set of tendons which, of the two sets, is tensioned later (i.e. the tendons for which the connector is the "dead" anchorage) are anchored by means of compression fittings in the form of sleeves which are compressed onto the ends of the tendons, the sleeves being too large to pass through radial slots in the connector which receive the tendons. Until tensioned, the tendons are not positively held in the slots by the compressed sleeves. To anchor the other set of tendons, for which the connector is the "live" anchorage, split conical wedges seating in apertures of complementary shape have been used. These are placed in position before tensioning, since the tendons can be pulled through them when being tensioned.

SUMMARY OF THE INVENTION

It is an object of the present invention to provide a connector for use in the process described above which may be simple in construction and easy to use on site, but which also connects the untensioned set of tendons securely to the already tensioned set so that after being connected they remain in position ready for tensioning and so that during and after tensioning they remain securely located in the connector.

According to this invention, there is provided a connector for connecting a first set of concrete-reinforcing tendons end-to-end to a second set of concrete-reinforcing tendons, having first and second sets of bores to receive the first and second sets of tendons respectively, each bore providing a frusto-conical seat to receive a gripping wedge for gripping a tendon received in the bore, the frusto-conical seats of the first and second sets of bores tapering respectively towards opposite sides of the connector and one of the sets of bores having, associated with each bore of the set, means for resiliently urging the wedges into their seats.

This connector provides the advantage that both sets of tendons are gripped by means of wedges seated in frusto-conical seats which is a particularly secure form of grip.

The resilient force applied to one set of wedges has a number of advantages, particularly when the wedges in question are those which grip the set of tendons which are to be tensioned after casting of the concrete section being constructed. The force holds the wedges in position (at a location which may be difficult of access) in readiness to receive the corresponding tendons. Each tendon is inserted by pushing it into the wedge against the resilient force which then causes the wedge to assume the correct position to hold the tendon in place until tensioned.

Preferably the connector has a gripping plate in which the first and second sets of bores are positioned and a spacing member which is adapted to abut the gripping plate and at least partly houses the resilient means.

According to the invention in another aspect there is provided a connector for connecting a first set of concrete-reinforcing tendons end-to-end to a second set of concrete-reinforcing tendons, having a gripping plate which has first and second opposite faces and in which there are first and second sets of bores to receive the first and second sets of tendons respectively, each bore providing a frusto-conicalseat which in use receives a gripping wedge for gripping a tendon received in the bore, the frusto-conical seats of the first and second sets of tendons tapering respectively towards the first and second faces of the gripping plate, the connector further having a spacing member which in use abuts the said first face of the gripping plate while permitting passage of the first set of tendons to the first set of bores and which is recessed opposite the bores of the second set so as to receive the ends of the second tendons projecting therefrom and to receive resilient means adapted to urge the wedges in the second set of bores into their seats.

Preferably the second set of bores is located radially outside the first set, and the spacing member is a ring abutting the gripping plate in the region of the second set of bores.

The spacing member may be recessed in any suitable manner to receive the resilient means. For instance individual bores may be provided through the spacing member in register with the second set of bores in the gripping plate. Particularly preferred, however, are slots open axially towards the said second set of bores and open radially at the periphery of the spacing member. The bases of the slots opposite the axial openings can provide abutments for springs which constitute the resilient means urging the wedges of the second set of bores into their seats. To hold the springs in place, the said bases may themselves have recesses.

The gripping plate and spacing member may be securable to each other e.g. by bolts.

The first and second sets of bores may be parallel to each other. It is preferred, however, that the bores extend in the directions in which the tendons they receive extend immediately adjacent the connector.

The invention further provides a connector of the invention as described above in combination with sets of gripping wedges adapted to grip tendons in the first and second sets of bores. In addition, the invention provides a concrete element or structure, especially a post-stressed structure, containing one or more connectors of the invention.

BRIEF DESCRIPTION OF THE DRAWING

One embodiment of the invention will now be described by way of example with reference to the accompanying drawing in which the single FIGURE in an axial section of a connector embodying the invention in situ at the junction of the sections of a post-stressed concrete structure, tendons connected by the connector and the wedges gripping the tendons also being shown.

DESCRIPTION OF THE PREFERRED EMBODIMENT

In the drawing, the connector 1 embodying the invention is shown in position in abutment with the end face of a conventional funnel member 3 which is embedded in the concrete 5 of an already cast and post-stressed section of the concrete structure. At the stage shown, the concrete of the next succeeding section of the structure has not been moulded but a sleeve 7 is already in position to protect the connector 1 from the concrete which is to be cast around the sleeve 7 against the end face 9 of the previous section.

Three of the tendons 11 which stress the concrete section 5 are shown anchored in the connector 1, which for them forms the "live" anchorage. The tendons 11 are strands, i.e. each consists of a plurality of single wires twisted together and there may be for example eight tendons 11 in total. They are suitably anchored by a "dead" anchorage, which may be another connector of the illustrated kind, at the other end of the section 5 of the structure. To tension the tendons 11, a jack is used to draw them through the connector 1, whereafter excess length is cut off.

One of the second set of tendons 13, which after pouring of the next concrete section will be tensioned in order to stress that section, is shown. Again there may be for example eight in total of these tendons 13. After tensioning of the tendons 13, grouting material is, in the usual manner, inserted within the sleeve 7 and funnel 3 to grout the tendons 11, 13.

The connector 1 consists of a circular plate 15 and a spacing member 17 in the form of a ring secured together by bolts 19 (only one being shown) passing through bores 21 in the plate 15 into screw-threaded bores 23 in the ring 17. The plate 15 has first and second opposite faces 25, 27 respectively, the first face 25 abutting a face 29 of the ring 17. At its side remote from the face 29 the ring 17 has an annular flange 31 small enough to fit within the funnel 3 in order to centre the ring 17. In use, as shown, the ring 17 serves to space the plate 15 from the completed concrete section 5.

The plate 15 has a first set of bores 33 corresponding in number to the number of tendons 11 and over part of their length having frusto-conical shape tapering towards the first face 25 and formings seats 35 for conical split wedges 37 which grip the tendons 11 to anchor them in the bores 33. On a circle radially outside the location of the bores 33 is a second set of bores 39 corresponding in number to the number of tendons 13 and likewise providing frusto-conical seats 41 for conical split wedges 43 which grip the tendons 13 when tensioned to anchor them in the plate 15. The conical portions 41 taper towards the second face 27 of the plate 15. The ring 17 abuts the face 25 at the region where the bores 39 emerge, its central aperture permitting passage of the tendons 11 to the bores 33.

In the ring 17 there are a set of slots 45 open to the periphery of the ring and also at the face 29 and in register with the bores 39 in the plate 15. The slots 45 receive the ends of the tendons 13 protruding from the bores 41 and also contain springs 47 which have the function of urging the wedges 43 into their seats. Each spring 47 acts between the base 49 of the slot 45, which has a recess in order to hold the spring in place, and a ring 51 engaging the wide ends of the wedges 43.

The connector 1 is used in the fabrication of a concrete structural element as follows. Before or after the moulding of the section 5, the connector is assembled in position against the funnel 3 with the tendons 11 received in the bores 33 and the wedges 37, 43 and springs 47 and rings 51 in place and with the ring 17 and plate 15 connected together by the bolts 19. After moulding of the section 5 the tendons 11 are tensioned with the use of a tensioning jack which after extending the tendons 11 forces the wedges 37 into place to anchor the tendons 11. The first concrete section is now complete and construction of the second begins. The tendons 13 are passed into the bores 39 displacing the wedges 43 slightly against the springs 47 which thereafter cause the wedges 43 to grip the tendons 13 lightly and hold them in place during subsequent operations. The sleeve 7 and other parts protecting the tendons 13 are placed in position and the concrete of the second section is poured. Thereafter the tendons 13 are tensioned by application of a jack to their other ends, and the wedges 43 firmly grip them in the connector 1 to form the "dead" anchorage.

It is particularly advantageous that the wedges 43 are held in place by the springs 47, because as a consequence the tendons 13 can merely be pushed into the bores 39 and are immediately gripped in the desired manner by the wedges 43 and are held in position until tensioning takes place. It will be appreciated that the connector is of simple construction and that the wedges 43, 37 may be standard parts. Manufacture of the ring 17 can be simplified by omission of the flange 31.

In the illustrated embodiment, the axes of the bores 39 are parallel to the axes of the bores 33. As a result, because the tendons 13 are not, in the region of the connector, parallel to the tendons 11, the tendons 13 have a bend where they enter the bores 39. In an alternative embodiment the bends in the tendons 13 are avoided by making the axes of the bores 39 at an angle to those of the bores 23 and aligned in the direction in which the tendons 13 extend immediately outside the plate 15 (thus the bores 39 are not parallel to each other but notionally have their axes on the surface of a cone coaxial with the general axis of the connector).

The use of the term "bore" to describe the apertures 39, 33 does not of course imply that they must be formed by boring. They may be formed in any suitable manner.

As shown, the ring 17 has a large central aperture to permit passage of the tendons 11 to the bores 33. Alternatively, the ring 17 may be replaced by a plate having individual bores for each tendon 11.

While the invention has been illustrated above by reference to one preferred embodiment and some variations thereof, it will be understood by those skilled in the art that various changes may be made without departing from the spirit and scope of the invention and it is intended to cover all such changes and modifications by the appended claims.

I claim:

1. A connector for connecting a first set of concrete-reinforcing tendons end-to-end to a second set of concrete-reinforcing tendons, comprising a gripping plate and a spacing member adapted to abut the gripping plate, the gripping plate having first and second sets of bores to receive the first and second sets of tendons respectively, each bore providing a frusto-conical seat to receive a gripping wedge for gripping a tendon received in the bore, the frusto-conical seats of the first and second sets of bores tapering respectively towards opposite sides of the connector and one of the sets of bores having, associated with each bore of the set, means for resiliently urging the wedges into their seats, and the resilient means being at least partly housed in said spacing member.

2. A connector according to claim 1 wherein the spacing member is a plate having a peripheral edge and first and second opposite faces and having slots open at the first face, which face in use abuts the said gripping plate, and open also at the said peripheral edge, said slots being adapted to register with the said set of bores having resilient means associated therewith and to house the said resilient means.

3. A connector for connecting a first set of concrete-reinforcing tendons end-to-end to a second set of concrete-reinforcing tendons, having a gripping plate which has first and second opposite faces and in which there are first and second sets of bores to receive the first and second sets of tendons respectively, each bore providing a frusto-conical seat which in use receives a gripping wedge for gripping a tendon received in the bore, the frusto-conical seats of the first and second sets of tendons tapering respectively towards the first and second faces of the gripping plate, the connector further having a spacing member which in use abuts the said first face of the gripping plate while permitting passage of the first set of tendons to the first set of bores and which is recessed opposite the bores of the second set so as to receive the ends of the second tendons projecting therefrom and to receive resilient means adapted to urge the wedges in the second set of bores into their seats.

4. A connector according to claim 3 wherein the second set of bores is located radially outside the first set, and the spacing member is a ring abutting the gripping plate in the region of the second set of bores.

5. A connector according to claim 3 wherein the said spacing member is recessed by being provided with slots open axially towards the said second set of bores and open radially at the periphery of the spacing member.

6. A connector according to claim 5 wherein the said slots have bases opposite the bores of the said second set, and the said resilient means are springs received in the said slots and abutting at one end on the said bases and at their other ends engaging the said wedges of the second set to urge them into their seats.

7. A connector according to claim 3 wherein the first and second sets of bores are mutually parallel.

8. A connector according to claim 3 wherein the bores of at least one of the first and second sets of bores extend substantially in the directions in which the tendons they receive extend immediately adjacent the connector, so that bends in the tendons at the entrance to the bores are substantially avoided.

9. A post-stressed concrete structure containing at least one pair of sets of tendons connected together by a connector according to claim 1.

* * * * *